United States Patent [19]

Mayz

[11] Patent Number: 4,800,373

[45] Date of Patent: Jan. 24, 1989

[54] LOW PRESSURE WARNING DEVICE FOR SCUBA DIVERS

[76] Inventor: Allan Mayz, 7 Academy St., Staunton, Va. 24401

[21] Appl. No.: 89,157

[22] Filed: Aug. 25, 1987

[51] Int. Cl.[4] ..... G08B 21/00

[52] U.S. Cl. ..... 340/626; 128/201.27; 137/81.2

[58] Field of Search ..... 340/626, 611, 614, 514, 340/515, 516; 128/201.27, 201.28; 137/81.2, 551, 557, 559; 73/714; 116/70

[56] References Cited

U.S. PATENT DOCUMENTS

| | | | |
|---|---|---|---|
| 3,524,444 | 8/1970 | Ellard | 128/201.27 |
| 3,794,059 | 2/1974 | Burt, Jr. | 340/626 |
| 4,598,279 | 7/1986 | Nowacki et al. | 340/626 |

*Primary Examiner*—Joseph A. Orsino, Jr.
*Assistant Examiner*—Jill D. Jackson
*Attorney, Agent, or Firm*—Jerry T. Kearns

[57] ABSTRACT

A low pressure warning device for use by scuba divers attaches to a fitting on the high pressure stage of the air tank. The warning device has both audible and visual indicators contained in a housing attached adjacent the air pressure gauge. A two stage warning to indicate a first low pressure and a second dangerously low pressure may be provided.

1 Claim, 2 Drawing Sheets

LOW PRESSURE WARNING DEVICE FOR SCUBA DIVERS

BACKGROUND OF THE INVENTION

1. Field of the Invention

The present invention relates to low pressure warning devices, and more particularly pertains to embodiments of a new and improved low pressure warning device for use by scuba divers having both audible and visual indicators. Scuba divers are dependent upon a tank of compressed air to sustain respiration. The pressurized air in the tank is fed to a regulator to reduce the pressure to a level where it may be safely breathed by the diver. This pressure level is adjusted by the regulator depending on the current depth of the diver. The high pressure side of the regulator is conventionally monitored by a pressure gauge as an indication of the air supply remaining in the tank. A sufficient reserve must be maintained in the tank to allow the diver to ascend according to established rates to avoid rapid decompression which induces air embolism or the bends. This condition is also known as caisson disease, and is an extremely painful and life threatening illness. Divers must be constantly alert to the remaining air supply in the tank. A diver's attention is divided between the assigned task to be accomplished, or in the case or recreational divers, between their observations of aquatic marine life and photography, and the monitoring of the remaining air supply. The present invention is directed to a device for monitoring the remaining air supply and indicating a low air supply to the diver by both audible and visual signals.

2. Description of the Prior Art

Various types of indicating devices for monitoring pressure in containers are known in the prior art. A typical examples of such a device is to be found in U.S. Pat. No. 2,321,293, which issued to G. Hassler on June 8, 1943. This device utilizes a "U" shaped manometer and an associated scale to measure pressure in a container. U.S. Pat. No. 3,965,317, which issued to J. Gratzmuller on June 22, 1976, discloses a magnetically actuated switch for indicating the position of a piston in a fluid accumulator. U.S. Pat. No. 4,146,887, which issued to P. Magnante on Mar. 27, 1979, discloses a gas or vapor sensing alarm for use in an air purifying respirator. An exothermic sensor which can be fitted in the cartridge adapter or facepiece of the respirator monitors the heat evolved during adsorption of the gas or vapor into the sensor's adsorbent and triggers a visual or audible alarm. U.S. Pat. No. 4,191,952, which issued to P. Schreiber et al. on Mar. 4, 1980, discloses a device for monitoring relative flows in anesthesia gas and oxygen pipelines. A differential pressure sensing unit including diaphragms in both the oxygen and anesthesia pipelines triggers an alarm when the oxygen concentration drops below a predetermined limit value. U.S. Pat. No. 4,613,851, which issued to J. Hines on Sept. 23, 1986, discloses a device for monitoring pressure in pressurized carbon dioxide cylinders utilized in beverage dispensing systems. Magnetic reed switches mounted on the indicating needle and scale of a pressure gauge actuate staged alarms at a remote location dependent upon sensed pressure descent to first and second predetermined levels.

While the devices described above provide visual and audible indication of the pressure in a container at a remote location, none of these devices is suitable for use by a scuba diver, thus it can be appreciated that there is a continuing need for and interest in improvements in devices for monitoring and indicating low pressure conditions in scuba diving air tanks, and in this respect, the present invention adresses this need and interest.

SUMMARY OF THE INVENTION

In view of the foregoing disadvantages inherent in the known types of low pressure warning devices now present in the prior art, the present invention provides an improved low pressure warning device. As such, the general purpose of the present invention, which will be described subsequently in greater detail, is to provide a new and improved low pressure warning device which has all the advantages of the prior art low pressure warning devices and none of the disadvantages.

To attain this, representative embodiments of the concepts of the present invention are illustrated in the drawings and make use of a pressure actuated switch connected to the high pressure stage of a scuba tank. Other features of the invention include battery operated audible and visual indicators actuated by a fall in pressure in the scuba tank below a predetermined level. In one embodiment of the invention a two stage indication of a fall in pressure within the scuba tank below a first predetermined level and a second lower predetermined level is provided. Additionally, the embodiments of the invention make use of a housing containing an audible alarm arranged to be positioned near the head of a diver and a visual indicator positioned to be visible to the diver in the normal horizontal swimming position. As such, a scuba diver is provided with a low pressure warning device which features dual visual and audible signals when the air supply is diminished to first and a subsequent second predetermined level.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved low pressure warning device which has all the advantages of the prior art low pressure warning devices and none of the disadvantages.

It is another object of the present invention to provide a new and improved low pressure warning device which may be easily and efficiently manufactured and marketed.

It is a further object of the present invention to provide a new and improved low pressure warning device which is of a durable and reliable construction.

An even further object of the present invention is to provide a new and improved low pressure warning device which is susceptible of a low cost of manufacture with regard to both materials and labor, and which accordingly is then susceptible of low prices of sale to the consuming public, thereby making such low pressure warning devices economically available to the buying public.

Still yet another object of the present invention is to provide a new and improved low pressure warning device which provides in the apparatuses and methods of the prior art some of the advantages thereof, while simultaneously overcoming some of the disadvantages normally associated therewith.

Still another object of the present invention is to provide a new and improved low pressure warning device which provides both visual and audible signals.

Even still another object of the present invention is to provide a new and improved low pressure warning device having a dual stage warning of a first reduced level of remaining air supply in a scuba tank and a second further reduced level of remaining air supply.

A further objective of the prsesent invention is to provide a new and improved low pressure warning device for scuba air tanks having an audible signal positioned near the head of a scuba diver and a visual signal positioned to be visible by a scuba diver in a normal swimming position.

These together with other objects of the invention, along with the various features of novelty which characterize the invention, are pointed out with particularity in the claims annexed to and forming a part of this disclosure. For a better understanding of the invention, its operating advantages and the specific objects attained by its use, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
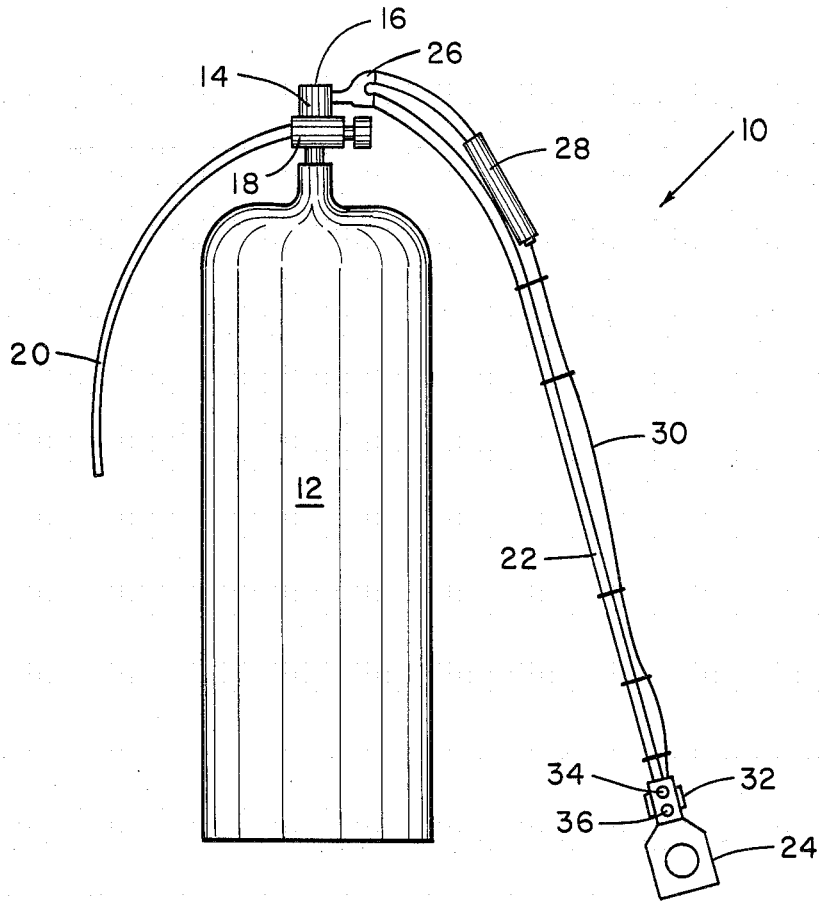
FIG. 1 is a perspective view of the low pressure warning device of the present invention installed on a scuba air tank.

With reference now to the drawings, and in particular to FIG. 1 thereof, a new and improved low pressure warning device embodying the principles and concepts of the present invention and generally designated by the reference numeral 10 will be described.

More specifically, it will be noted that the first embodiment 10 of the invention is designed for use with a scuba air tank 12 having a regulator 14 having a high pressure stage 16 and a low pressure stage 18. A low pressure line 20 connects the low pressure stage to a mouthpiece (not shown). A pressure gauge 24 is suspended from the high pressure stage by a line 22, and is arranged to be suspended within a scuba diver's field of vision when in a normal horizontal swimming position. The aforesaid assembly is a typical conventional scuba air tank apparatus. The low pressure warning device 10 of the instant invention includes a first main housing assembly 28 and a second visual indicator housing assembly 32 operatively connected to the main housing assembly by a cable 30. An amber lens 34 and a red or orange lens 36 are provided on the visual indicator housing assembly. For use on regulators which have only one high pressure stage connection, a "Y" fitting 26 is provided. When using a regulator of the type having two high pressure stage connections, the "Y" fitting is unnecessary.

Figure 2:
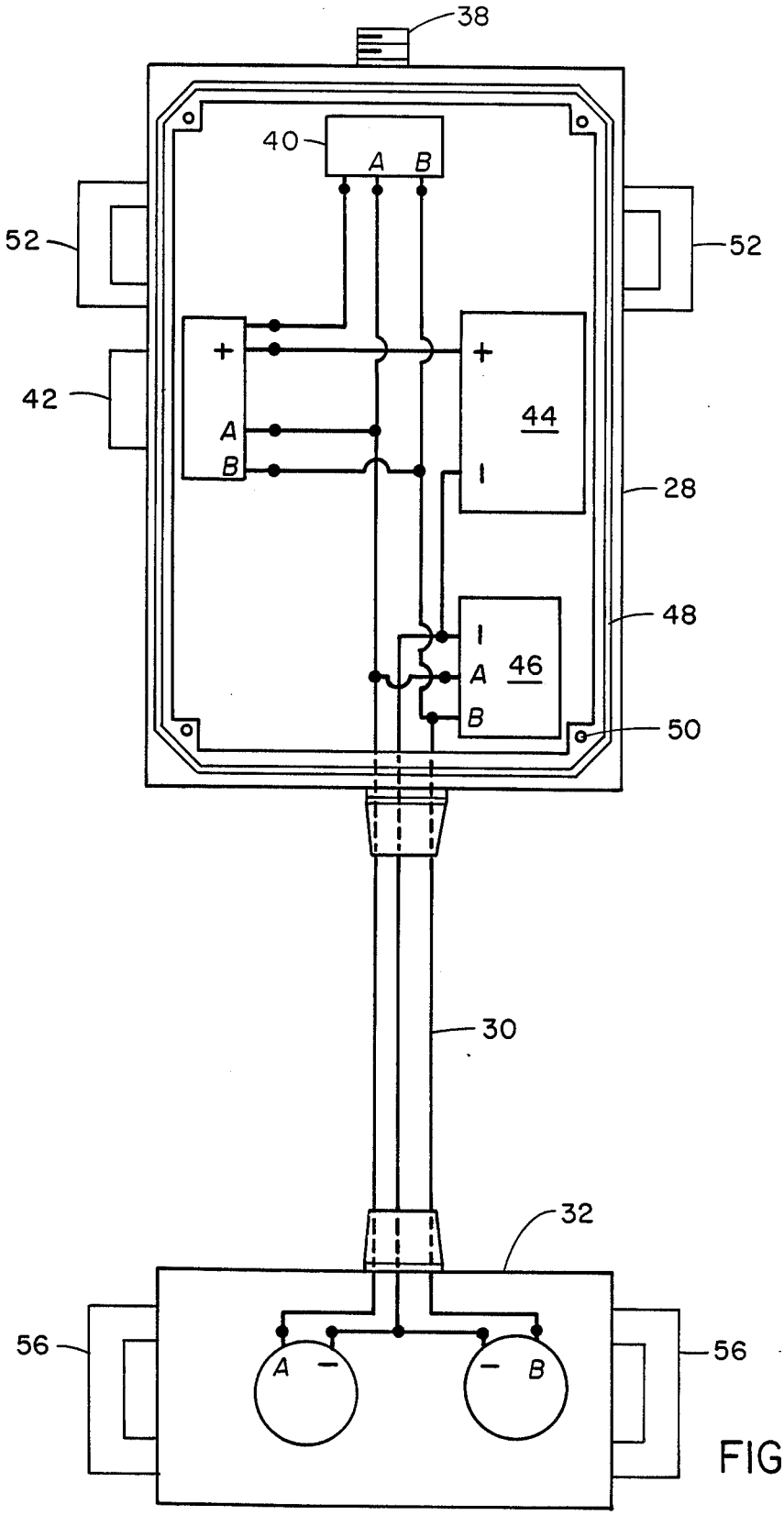
FIG. 2 is a top view of the low pressure warning device of the instant invention with the housing covers removed.

With reference now to FIG. 2, it may be seen that a fitting 38 extends through an end wall of the first main housing assembly. This fitting serves to connect a pressure switch 40 received in the main housing assembly to the high pressure stage of the regulator. The pressure switch is preferably a two stage switch which responds to a reduction in pressure to first and second predetermined levels. Such a switch may utilize a plunger which is backed by a coil spring having a predetermined spring constant. When the switch is connected to a fully pressurized scuba air tank, the plunger completely compresses the spring. Upon a reduction in pressure applied to the plunger to a first predetermined level, the plunger is extended to a first position and makes a first pair of contacts. Upon a further reduction in the pressure applied to the switch, the plunger extends to a second position and makes a second pair of contacts. Other known types of pressure switches may also be utilized. Also extending through a wall of the main housing is a three position switch 42. The switch has a first position for "On", a second position for "Off" and a third "Test" position. A battery 44 and a two stage audible alarm 46 are operatively connected within the main housing. The audible alarm may provide any desired audible signal, but should produce at least a 90 db signal. Cable 30, extending through waterproof grommets in the main and visual indicator housing, operatively connects a pair of indicating lamps 54. These are preferably of the halogen type to provide a bright visual signal. The main and visual indicator housings are provided with "O" ring seal grooves 48 and threaded holes 50. As is readily apparent "O" rings are placed in these grooves and the housing covers are secured by screws received in the threaded holes. Attaching brackets 52 and 56 are provided for securing the housings in position by VELCRO straps. The housings and switches are constructed to withstand pressures of 6.8 atmospheres which provides a 200 foot depth rating with a 25 foot safety factor.

With further reference to FIG. 2, the operation of the low pressure warning device of the instant invention will be described. Upon complete depression of the three position switch 42, switch terminals A and B are connected together and to the positive battery terminal. At all other times these switch terminals A and B are electrically isolated. In this fully depressed switch position both stages of the two stage audible alarm 46 and both indicating lamps 54 are connected through the battery. This provides a test of the battery, the audible alarm and both lamps. It will be noted that the circuit elements are wired in parallel so that failure of one component will not preclude operation of the other elements. Upon releasing the switch 42, a second detent position is reached in which the positive terminal of the battery is connected to the positive terminal of the pressure switch 40. As previously mentioned, this pressure switch has a two stage operation; at a first reduced pressure of 750 psig the pressure switch makes contact A, providing power to the first stage of audible alarm 46 and to one visual indicating lamp. At a second reduced pressure of 600 psig, the pressure switch makes contact B, thus providing power to the second stage of the audible alarm and to the second visual indicating lamp. In a third detent position switch 42 disconnects battery 44 from the circuit, thus turning the device off. While the above described circuit is preferred, it is readily apparent that other circuits to provide for flashing lights and intermittent audible alarm operation may be utilized.

Figure 3:
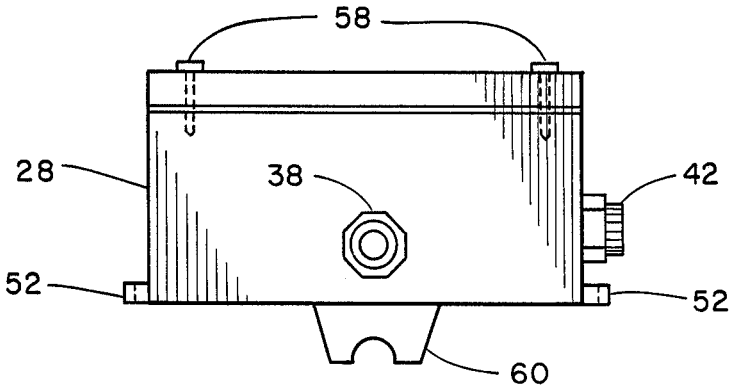
FIG. 3 is an end view of the low pressure warning device of the instant invention.

With reference now to FIG. 3, the manner of attachment of the housing covers by screws 58 is illustrated. Also, hose clips 60 are provided for securing the housings to the high pressure gauge line.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. In combination with a scuba air tank having a regulator with a high pressure stage, and a pressure gauge suspended from said high pressure stage by a line, the improvement comprising:

first housing means attached to an upper portion of said line;

pressure switch means, in said first housing means, connected to said high pressure stage and actuated by a decrease of air pressure in said scuba air tank to a first predetermined level;

audible signal means in said first housing means actuated by said pressure switch means;

second housing means operatively connected to said first housing means and attached to a lower portion of said line adjacent said pressure gauge;

visual signal means in said second housing means actuated by said pressure switch means;

said audible signal means providing a first audible signal upon a decrease in pressure in said scuba air tank to a first predetermined pressure and a second audible signal which is different from said first audible signal in response to a further reduction in pressure in said scuba air tank to a second predetermined level;

said visual signal means comprising an amber light activated upon a decrease in pressure in said scuba air tank to said first predetermined level and a red light activated by reduction in pressure in said scuba air tank to said second predetermined level;

battery means in said first housing means for powering said audible and visual signal means;

second switch means connected between said battery means and said pressure switch means for deactivating said audible signal means;

and said second switch means comprising a three position switch having a first position in which said audible signal means is controlled by said pressure switch means, a second position in which said audible signal means is deactivated and a third position for testing said audible signal means.

* * * * *